US005790933A

United States Patent [19]

Williams

[11] Patent Number: 5,790,933

[45] Date of Patent: Aug. 4, 1998

[54] LEVELING ENHANCEMENT TO TRAY CABLE LIFT SYSTEM

[75] Inventor: Stephen B. Williams, Ontario, N.Y.

[73] Assignee: Xerox Corporation, Stamford, Conn.

[21] Appl. No.: 753,624

[22] Filed: Nov. 27, 1996

[51] Int. Cl.[6] ..... G03G 15/00

[52] U.S. Cl. ..... 399/393; 271/126

[58] Field of Search ..... 399/393; 271/147, 271/160, 145, 126, 127

[56] References Cited

U.S. PATENT DOCUMENTS

| | | | |
|---|---|---|---|
| 3,709,595 | 1/1973 | Turner et al. . | |
| 3,995,952 | 12/1976 | Schoppe . | |
| 4,455,115 | 6/1984 | Alger et al. | 271/217 X |
| 4,538,906 | 9/1985 | Brown . | |
| 4,553,831 | 11/1985 | Dixon . | |
| 4,673,279 | 6/1987 | Brown . | |
| 4,711,443 | 12/1987 | Fujiwara et al. | 271/126 |
| 4,718,658 | 1/1988 | Hirose et al. | 271/258.04 |
| 4,835,573 | 5/1989 | Rohrer et al. . | |
| 5,215,299 | 6/1993 | Luft | 271/160 |
| 5,305,996 | 4/1994 | Taniwa et al. | 271/22 |
| 5,451,039 | 9/1995 | Adachi | 271/9.06 |

*Primary Examiner*—Robert Beatty
*Attorney, Agent, or Firm*—John S. Wagley

[57] ABSTRACT

A media tray lifting mechanism for use with a driving mechanism to present sheet media for processing in a printing machine is provided. The mechanism includes a tray for supporting the sheet media and a cable affixed in at least three spaced apart positions to the tray to form cable connections. The mechanism also includes a plurality of support pulleys affixed to the printing machine and movably attached to the cable for supporting the cable within the machine. At least two of the support pulleys is associated with each of the cable connections to form pulley sets. At least one of the support pulleys within each pulley set subtends another pulley within the pulley set to provide a substantially vertical section of the cable between the pulleys. An adjustment pulley is movably secured to the printing machine and is movably attached to the cable. The adjustment pulley is positioned between adjacent sets of pulley sets.

13 Claims, 5 Drawing Sheets

LEVELING ENHANCEMENT TO TRAY CABLE LIFT SYSTEM

This invention relates generally to a paper tray gauge for a printing machine, and more particularly concerns a multifunction paper tray gauge for an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. After each transfer process, the toner remaining on the photoconductor is cleaned by a cleaning device.

The productivity of electrophotographic copy machines and printers has increased greatly over the years. Many of these machines are capable of producing 60 to 200 copies per minute and several machines are capable of even higher productivities. These faster, high productive machines require large quantities of paper. In order to maintain the productivity of these machines, the number of machine interruptions to add paper are preferably minimized. Solutions to this paper change problem include the use of multiple paper trays, paper trays which may be accessed during the operating of the machine, and higher capacity paper feeders. The use of higher capacity paper feeders is particularly popular in recent years.

The use of copy machines and printers with cut 8 ½×11 inch sheets of copy paper and particularly those copy machines that have high capacity output require accurate placement of the sheets to be fed through the copy machine. Typically, these sheets are stacked on trays. The sheets are fed from the trays with the top sheet fed first. This means that the trays are raised and lowered to align the sheet to be fed with a paper feed mechanism located within the machine. For low capacity feed trays, the feed trays may be spring biased with a spring force pushing the top sheet of the tray upward against a stop. The sheet can then be fed from the top.

For higher capacity feeders, for example, for those feeders having a capacity of one thousand sheets or more, the use of spring biased feed trays is increasingly difficult. The greater spring force which is required to urge the trays upwardly interferes with the pulling of the top sheet from the tray.

A solution to this problem is to utilize a motor to position the top sheet of the tray in a constant position in alignment with the feed mechanism. This motor is typically an electrical motor. This motor must position the paper in a fairly accurate alignment with the feed mechanism of the machine. In prior art, high capacity feed trays for copiers and printers the use of a suspended cable and pulley system has been used. Such a system is shown in U.S. Pat. No. 4,835,573 to Rohrer et al., the relevant portions thereof incorporated herein by reference. The cable is attached to the tray at the four corners of the tray and a capstan is wound about the cable. A motor attached to the capstan is used to advance the cable in each of two opposed directions. A rotary encoder or other positioning feature is used with the motor to provide controlled positioning of the motor and correspondingly the tray.

Prior art tray cable lift systems are very difficult to align. During assembly of the tray cable lift system, the associated pulleys are positioned into predetermined locations and the cable is secured to the tray at various predetermined locations. The position of the tray with respect to the copy machine is thus established and fixed upon the assembly of the copy machine. Assembly fixtures and assembly gauges may minimize the inaccuracies of the location of the tray relative to the machine. However, there are practical limits to the accuracy of the tray position within the machine. As the trays become larger and accommodate a greater number of copy sheets, the accuracy requirements of the tray position becomes increasingly more precise.

Further, during shipment, the cable and copy machine frame may twist or distort causing inaccuracies in the position of the tray. Further, with time, the cable may stretch and the frame of the copy machine may distort. Further, wear may occur to the pulleys. Furthermore, in large complex copy machines where various modules are interconnected during assembly, the tray may be accurately positioned within the module but have positioning errors with respect to adjoining modules.

The present invention is directed to alleviate at least some of the aforementioned problems.

The following disclosures may be relevant to various aspects of the present invention:

U.S. Pat. No. 4,835,573

Inventor: Rohrer et al.

Issue Date: May 30, 1989

U.S. Pat. No. 4,673,279

Inventor: Brown

Issue Date: Jun. 16, 1987

U.S. Pat. No. 4,553,831

Inventor: Dixon

Issue Date: Nov. 19, 1985

U.S. Pat. No. 4,538,906

Inventor: Brown

Issue Date: Sep. 3, 1985

U.S. Pat. No. 3,995,952

Inventor: Schoppe

Issue Date: Dec. 7, 1976

U.S. Pat. No. 3,709,595

Inventor: Turner et al.

Issue Date: Jan. 9, 1973

The relevant portions of the foregoing disclosures may be briefly summarized as follows:

U.S. Pat. No. 4,835,573 discloses a cable suspension elevator system for a tray for containing a stack of sheets in a printing machine. An output shaft of a drive motor is connected to rotate take-up spools. The rotation of motors in a first direction causes cables to wrap around spools. Rotation in the opposite direction caused cables to unwind from the spools. The cables pass over pulleys and are attached to the tray at their other ends thereby pulling the tray upwardly.

U.S. Pat. No. 4,673,279 discloses a cable suspension elevator system for a main tray and an auxiliary tray for containing stacks of sheets in a printing machine. An output shaft of a drive motor is connected to rotate a capstan. The cable drive system comprises a cable having its opposite ends connected to the capstan mounted on the back of the lower tray. The cable passes under a pair of pulleys fixed on the lower tray and over pairs of guide pulleys to the sub frame.

U.S. Pat. No. 4,553,831 discloses a cable suspension elevator system for a main tray and an auxiliary tray for containing stacks of sheets in a printing machine. An output shaft of a drive motor is connected to rotate a capstan. The cable drive system comprises a cable having its opposite ends connected to the capstan mounted on the back of the lower tray. The cable passes under a pair of pulleys fixed on the lower tray and over pairs of guide pulleys to the sub frame. A loop of cable between the pulleys passed under a pulley mounted on a slide block with is vertically movably.

U.S. Pat. No. 4,538,906 discloses a cable suspension elevator system for a main tray and an auxiliary tray for containing stacks of sheets in a printing machine. An output shaft of a drive motor is connected to rotate a capstan. The cable drive system comprises a cable having its opposite ends connected to the capstan mounted on the back of the lower tray. The cable passes under a pair of pulleys fixed on the lower tray and over pairs of guide pulleys to the sub frame. A loop of cable between the pulleys passed under a pulley mounted on a slide block with is vertically movably. The forward end of the auxiliary tray is attached to the slide block.

U.S. Pat. No. 3,995,952 discloses a cable suspension elevator system for a tray for containing a stack of sheets in a printing machine. An output shaft of a drive motor is connected to rotate take-up spools. The rotation of motors in a first direction causes cables to wrap around spools. Rotation in the opposite direction caused cables to unwind from the spools. The cables are attached to the tray for providing connection between the tray and the elevating mechanism. One end of each cable is connected to the respective tray tabs. The other end of each cable is supported about a respective idler pulley and then connected to a capstan about which it is wound.

U.S. Pat. No. 3,709,595 discloses a cable suspension elevator system for a tray for containing a stack of sheets in a printing machine. To move the tray, the motor is energized to rotate a pulley which carries a cable connected to a slide shaft. On the down movement during the side stacking operation the motor is only energized in the brief interval to effect incrementally lowering the tray due to a braking action on the motor when the motor is shut off.

In accordance with one aspect of the present invention, there is provided a media tray lifting mechanism for use with a driving mechanism to present sheet media for processing in a printing machine. The lifting mechanism includes a tray for supporting the sheet media and a cable affixed in at least three spaced apart positions to the tray to form cable connections. The lifting mechanism also includes a plurality of support pulleys affixed to the printing machine and movably attached to the cable for supporting the cable within the machine. At least two of the support pulleys is associated with each of the cable connections to form pulley sets. At least one of the support pulleys within each pulley set subtends another pulley within the pulley set to provide a substantially vertical section of the cable between the pulleys. An adjustment pulley is movably secured to the printing machine and is movably attached to the cable. The adjustment pulley is positioned between adjacent sets of pulley sets.

pursuant to another aspect of the present invention, there is provided an electrophotographic printing machine for developing a latent image on sheet media. The printing machine includes a media tray lifting mechanism for use with a driving mechanism to present the sheet media for processing in the printing machine. The lifting mechanism includes a tray for supporting the sheet media and a cable affixed in at least three spaced apart positions to the tray to form cable connections. The lifting mechanism also includes a plurality of support pulleys affixed to the printing machine and movably attached to the cable for supporting the cable within the machine. At least two of the support pulleys is associated with each of the cable connections to form pulley sets. At least one of the support pulleys within each pulley set subtends another pulley within the pulley set to provide a substantially vertical section of the cable between the pulleys. An adjustment pulley is movably secured to the printing machine and is movably attached to the cable. The adjustment pulley is positioned between adjacent sets of pulley sets.

pursuant to yet another aspect of the present invention, there is provided a method for adjusting the relative height of opposed ends of a rectangular tray for supplying a stack of sheet media in a supply bin of a printing machine. The method includes the steps of supporting the rectangular tray on the corners of the tray from a cable attached to a system of pulleys secured to the machine, movably mounting an adjustable pulley to the printing machine between adjacent corners of the tray, and adjusting the position of the adjustable pulley relative to the printing machine so that the relative height of opposed ends of a rectangular is adjusted.

Other features of the present invention will become apparent as the following description proceeds and upon reference to the drawings, in which.

Figure 4:
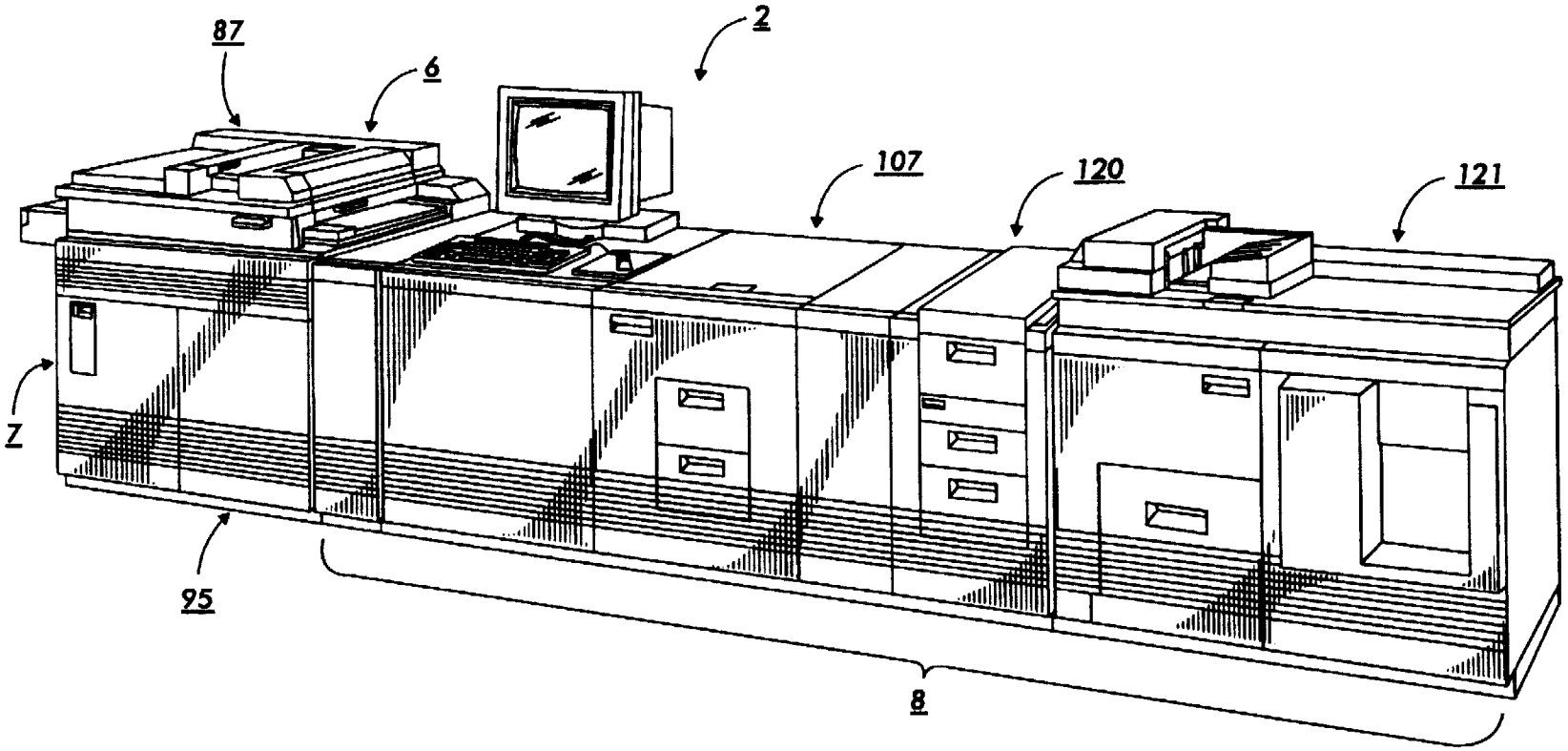
FIG. 4 is a perspective view of a printing machine utilizing the interposer of FIGS. 2 and 3.
Figure 5:
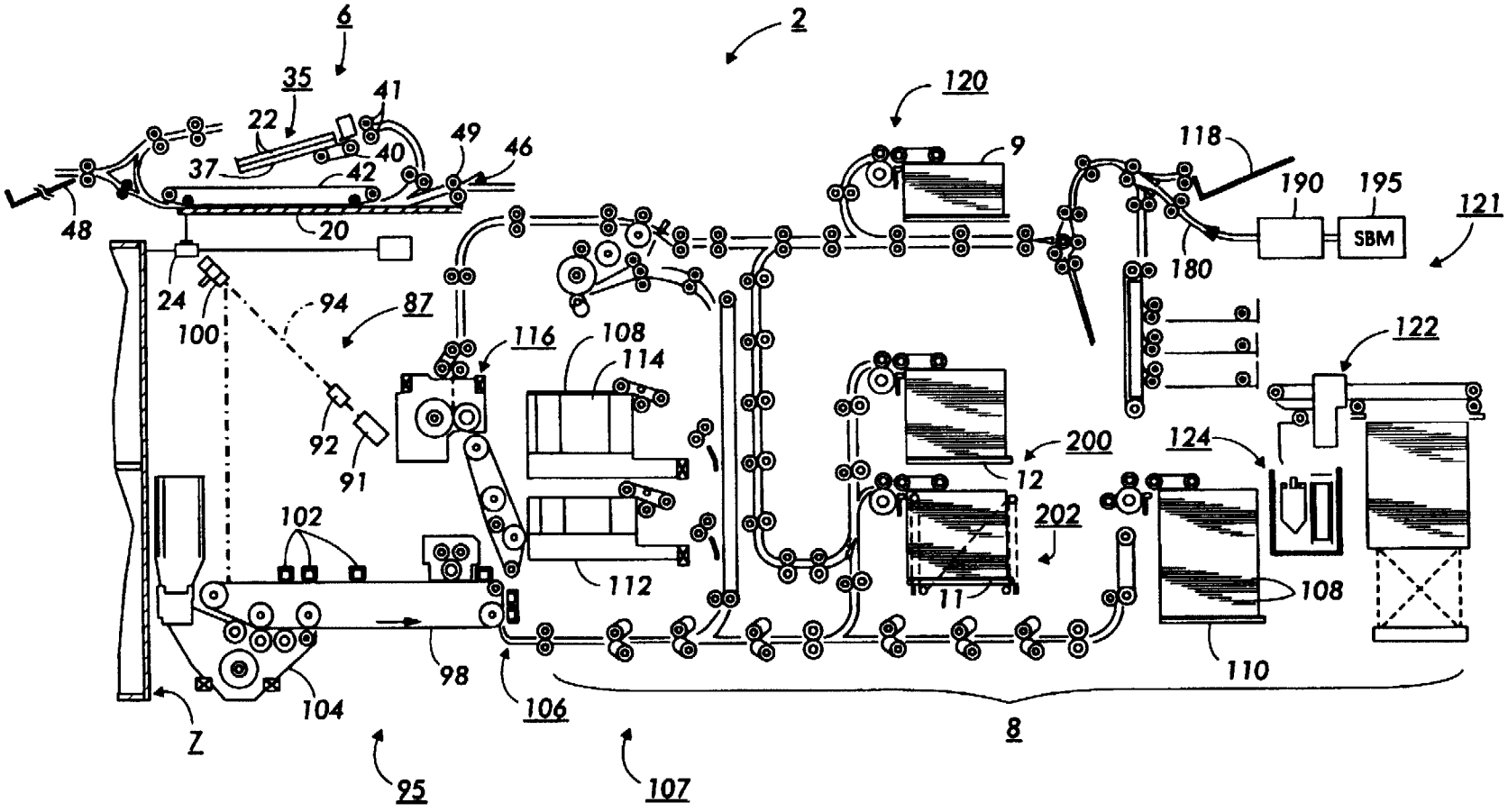
FIG. 5 is a schematic elevational view of the FIG. 4 printing machine.

Referring first to FIGS. 4 and 5, there is shown an exemplary laser based printing system (or imaging device) 2 for processing large, long print jobs utilizing a tray cable lift system with leveling enhancement in accordance with the teachings of the present invention. It should be appreciated that the present invention may be practiced in any printing machine utilizing a paper tray, the invention is particularly well suited for copy machines having large paper output capacities and utilizing several large paper trays such as the printing system 2. Printing system 2, for purposes of explanation, is divided into a scanner section 6, controller section 7, and printer section 8. While a specific printing system is shown and described, the present invention may be used with other types of printing systems such as ink jet, ionographic, etc., equivalents as may be included within the spirit and scope of the invention as defined by the appended claims. It should be particularly noted that the tray leveling enhancement of the present invention may be practiced equally as well on a light lens type of xerographic copier.

For off-site image input, image input section has a network with a suitable communication channel, such as an ethernet connection, enabling image data, in the form of image signals or pixels, from one or more remote sources, to be input to system 2 for processing. Other remote sources of image data, such as streaming tape, floppy disk, video camera, etc. may be envisioned.

Referring particularly to FIGS. 4 and 5, scanner section 6 incorporates a transparent platen 20 on which the document 22 to be scanned is located. One or more linear arrays 24 are supported for reciprocating scanning movement below platen 20. Array 24 provides image signals or pixels representative of the image scanned which, after suitable processing by processor (not shown), are output to controller section 7.

Processor converts the analog image signals output by array 24 to digital image signals and processes the image signals as required to enable system 2 to store and handle the image data in the form required to carry out the job programmed. Processor also provides enhancements and changes to the image signals such as filtering, thresholding, screening, cropping, reduction/enlarging, etc. Following any changes and adjustments in the job program, the document must be rescanned.

Documents 22 to be scanned may be located on platen 20 for scanning by automatic document handler (ADF) 35 operable in either a Recirculating Document Handling (RDH) mode or a Semi-Automatic Document Handling (SADH) mode. A manual mode including a Book mode and a Computer Forms Feeder (CFF) mode are also provided, the latter to accommodate documents in the form of computer fanfold. For RDH mode operation, document handler 35 has a document tray 37 in which documents 22 are arranged in stacks or batches. The documents 22 in tray 37 are advanced by vacuum feed belt 40 and feed rolls 41 onto platen 20 where the document is scanned by array 24. Following scanning, the document is removed from platen 20 and discharged into catch tray 48.

For operation in the CFF mode, computer forms material is fed through slot 46 and advanced by feed rolls 49 to document feed belt 42 which, in turn, advances a page of the fanfold material into position on platen 20.

Referring to FIGS. 4 and 5, printer section 8 comprises a laser type printer and, for purposes of explanation, is separated into a Raster Output Scanner (ROS) section 87, print Module Section 95, paper Supply Section 107, a post-xerographic paper processor, for example an interposer 120 for interposing sheets of preprinted stock into printed sheets from the xerographic engine and for supplying addition copy sheets for the xerographic engine and a High Speed Finisher 121. ROS 87 has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of print Module 95 by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by paper Supply section 107. Media 108, as will appear, may comprise any of a variety of sheet sizes, types, and colors. For transfer, the print media is brought forward in timed registration with the developed image on photoreceptor 98 from either a main paper tray 110 or from auxiliary paper trays 112 or 114. It should be appreciated that the main tray 110 and each of the auxiliary trays 112 and 114 may incorporate the leveling enhancement tray cable lift system of the present invention. It should be noted that the main tray 110 is particularly well suited for the lift system on the present invention in that the main tray must be aligned with the interposer 120 and the supply section 107.

Referring now to FIG. 4, the paper supply section 107, the interposer 120 and the finisher 121 are typically furnished as modules which may be separately procured and shipped. Acute alignment problems occur when attempting to accurately align the paper paths extending between the several modules. The alignment of the paper trays is a significant portion of the alignment problem.

Referring again to FIG. 5, the developed image transferred to the print media 108 is permanently fixed or fused by fuser 116 and the resulting prints pass through interposer 120 and are discharged to either output tray 118, to high speed finisher 121, or through bypass 180 to some other downstream finishing device, which could be a low speed finishing device such as a signature booklet maker (SBM) 195 of the type manufactured by Bourg AB. High speed finisher 121 includes a stitcher 122 for stitching or stapling the prints together to form books and thermal binder 124 for adhesively binding the prints into books.

The SBM 195 is coupled with the printing system 2, by way of bypass 180, for receiving printed signatures. A sheet rotary 190 is positioned at an input of the SBM and the SBM includes three stations, namely a stitching station, a folding station and a trimming station, in which a plurality of signatures are processed. In operation, the signatures are transported through the bypass 180 to the sheet rotary 190 where the signatures are rotated, if necessary. The signatures are then introduced to the stitching station where the signatures are assembled as a stitched booklet. The stitched booklet is delivered to the folding station where it is preferably folded in half with a folding bar. At the trimming station, uneven edges of the folded signature set are trimmed with a cutting blade. Further details regarding the structure and function of the SBM 195 can be obtained by reference to U.S. Pat. No. 5,159,395 to Farrell et al.

It will be understood that a particular advantage of the present invention is in its use in large throughput capacity complex machines with modules such as paper supply module 117, interposer 120 and finisher 121 which are very difficult to be accurately aligned. In the exemplary system shown and described herein, the customer is provided with three sheet feeding trays, 110 112 and 114, which can perform the function of multiple dedicated sheet feeding trays.

Figure 2:
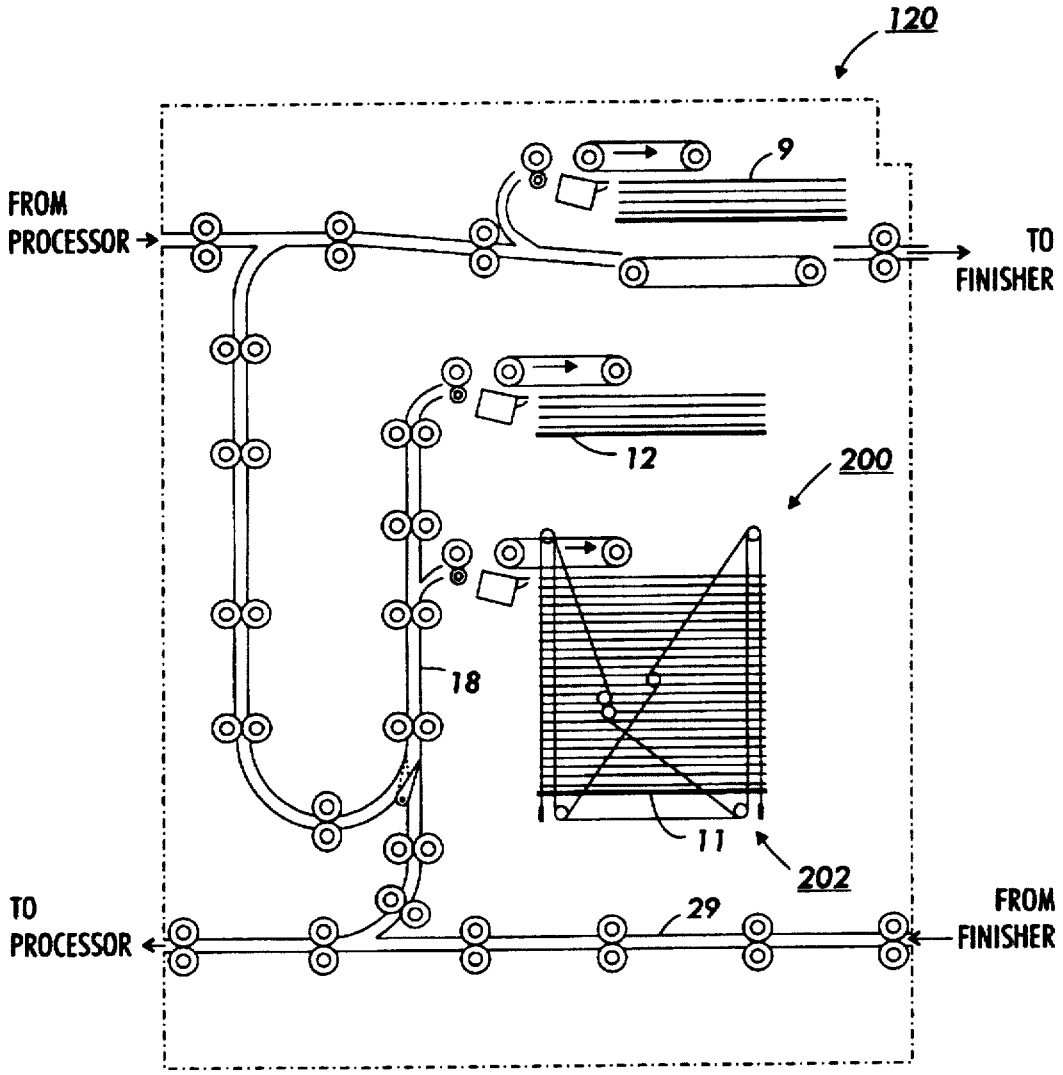
FIG. 2 is a schematic elevational view of an interposer incorporating the FIG. 1 tray cable lift system therein.
Figure 3:
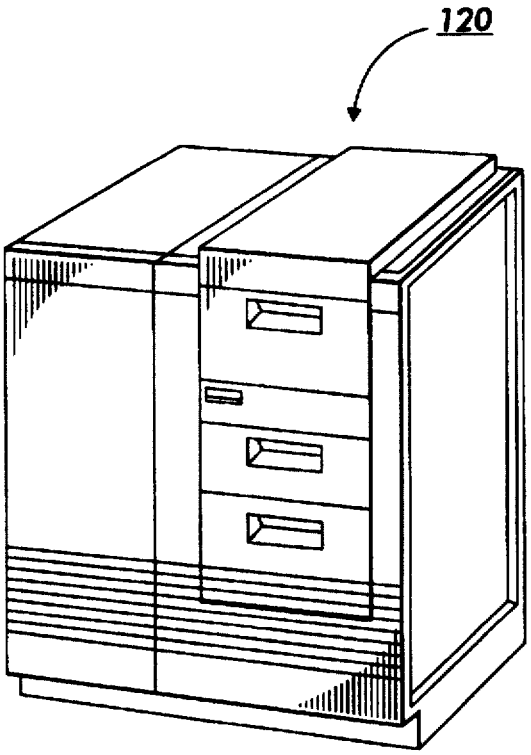
FIG. 3 is a perspective view of the interposer of FIG. 2.

It will be understood that the leveling enhancement of the present invention is particularly well suited when used in an add-on or in-line sheet feeding module such as interposer 120, as shown in particular in FIGS. 2 and 3. Interposer 120 can be interposed between an independent printing processor module such as supply section 107 and a finishing module 121. Add-on or in-line sheet feeding modules such as interposer 120 may be advantageous in providing various machine configurations depending on customer requirements.

For example, referring to FIG. 3, the interposer 120 might provide additional an copy sheet storage facility or additional sheet insertion capabilities as represented by additional inserter tray 9. Alternatively, or in addition, the add-on module may be provided with a paper path leading from the finisher to the xerographic processor, generally identified by reference numeral 29, for advantageous placement of a paper supply tray within the compartment of the finisher to add yet increased copy sheet storage. Also, the add-on module may or may not include a duplex handling tray (not shown), it being understood that this duplex handling tray may be incorporated solely into the xerographic machine 2. In the configuration shown in FIG. 2, additional auxiliary sheet feeding trays 11 or 12 may be coupled to the main paper supply transport 18 for supplying copy sheets to the xerographic printing section 6 or for supplying insert sheets directly to the finishing section 8 (see FIG. 5).

The leveling enhancement tray cable lift system may be incorporated into any or all of trays 9, 11, and 12. Since tray 11 is particularly large and since the alignment of the interposer between the supply section 107 and the finisher 121 is critical, the use of the present invention is particularly well suited to tray 11.

Figures 1, 1A:
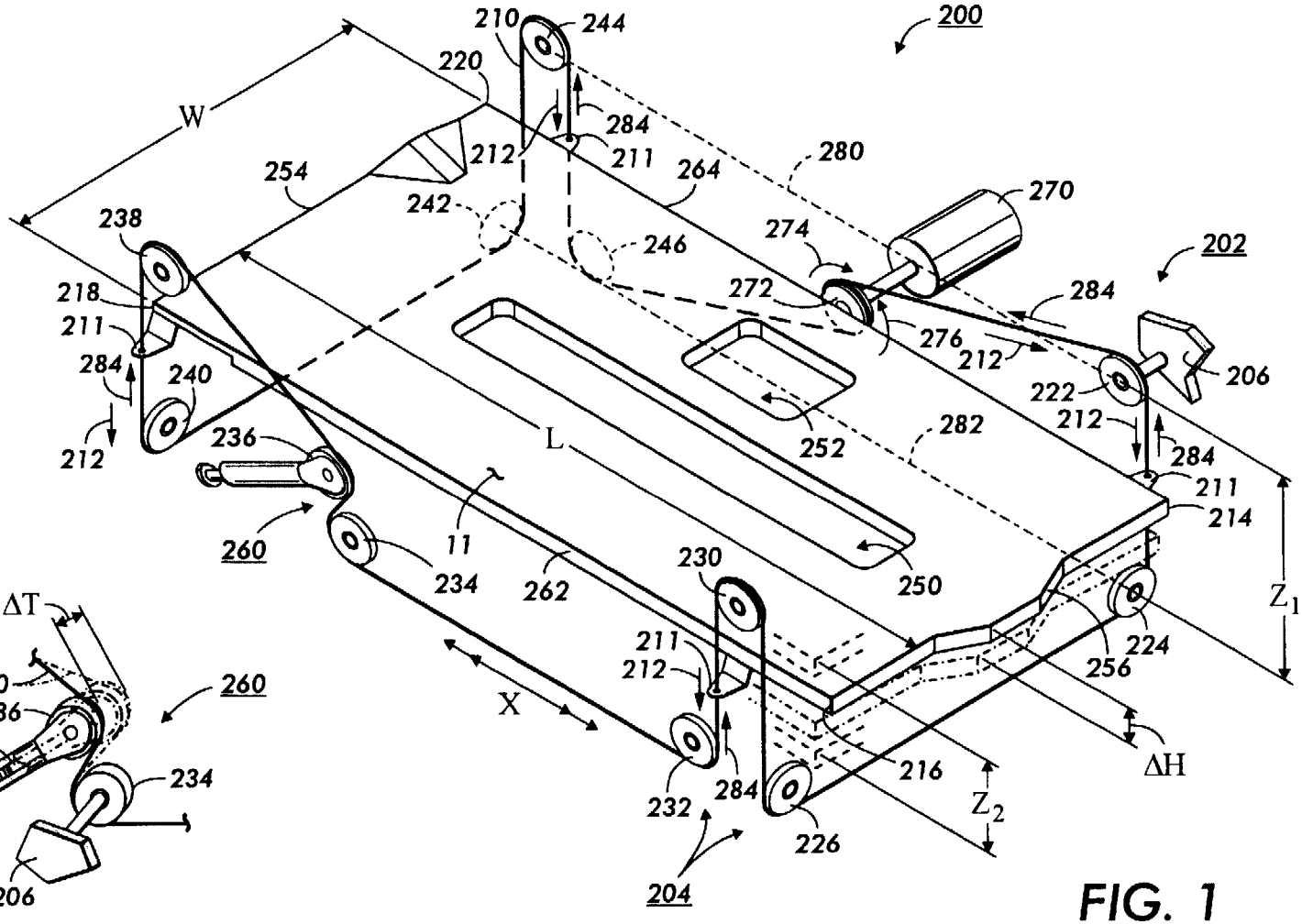
FIG. 1 is a perspective view of a paper tray leveling enhancement to tray cable lift system according to the present invention.
FIG. 1A is a partial plan view of the paper tray leveling enhancement to the tray cable lift system of FIG. 1 showing the pulley adjustment in greater detail.

According to the present invention, and referring to FIG. 1, a cable tray lift system 200 with leveling enhancement is shown. The tray cable lift system 200 includes a media tray lift mechanism 202 which is connected to feeding tray 11. The media tray lifting mechanism includes a plurality of pulleys 204 which are mounted to frame 206. The general configuration of a pulley and cable tray lift system is shown in U.S. Pat. No. 4,835,573 to Rohrer et al., the relevant portions thereof incorporated herein by reference.

The pulleys 204 may be any suitable commercially available pulley, for example, pulley No. 20K5560 available from J. C. Plastics, Incorporated.

A cable 210 is strung between the pulleys 204. The cable 210 may be made of any suitable, durable material. A standard wire cable is particularly well suited for this application. Such a cable, cable No. 12K3240, is available from Cable Manufacturing and Assembly Corporation.

The cable 210 is attached to tray 11 such that as the cable 210 advances along the pulleys 204, the tray 11 likewise moves.

For proper operation of the lifting mechanism 202, the cable 210 is secured to the tray 11 in at least three affixing positions 211 to provide stable lifting of the tray 11. Preferably, the three positions are not colinear so that more stable lifting of the tray is possible.

To permit lifting of the tray 11 by the lifting mechanism 202, the cable 210 is so strung about the pulleys 204, such that the cable 210 when moved in a first direction 212 causes an identical vertical motion in the same direction at each position where the cable 210 is affixed to the tray 11. This is accomplished by providing for a pulley 204 positioned above and below each of the affixing positions 211 of the cable 210 to the tray 11.

Preferably as shown in FIG. 1, the cable 210 is connected to tray 11 at the four opposed corners 214, 216, 218, and 220 of the tray 11. This configuration requires at the minimum eight pulleys 204, one pulley 204 above and one pulley 204 below each of the four corners 214, 216, 218, and 220.

Feeding tray 11 may be of sufficient size to handle any particular media for which it is designed. Preferably, however, tray 11 is designed be to able to be utilized with legal size paper; legal size paper being 8 ½ inches by 14 inches. The feeding tray 11 thus has a length L greater than 14 inches a width W greater than 8½ inches. The tray 11 may also include a side rail (not shown) and an end rail (not shown). The tray 11 may include a longitudinal aperture 250 for securing the end rail and a transverse opening 252 for securing the side rail.

Since the length L of the tray is significantly larger than the width W of the tray, and since the sheets are typically fed from either first end 254 or second end 256 of the tray 11, the relative heights of the ends 254 and 256 are particularly important. Therefore, the leveling enhancement to the tray cable lift system typically adjusts the height of the first end 254 relative to the height of the second end 256. The level enhancement thus provides for an adjustment in height $\Delta H$ from the first end 254 to the second end 256. Applicant has found that a height adjustment $\Delta H$ as large as approximately 0.20 inches, 0.25 inches or 0.315 inches, is sufficient to accommodate variations in wear and alignment of the feeding tray 11.

Leveling enhancement 260 is thus preferably positioned either along first side 262 or second side 264 of feeding tray 11. As shown in FIG. 1, leveling enhancement 260 is positioned along first side 262 of the tray 11.

Leveling enhancement 260 may have any suitable configuration and be made of any suitable, durable material. Leveling enhancement 260 may have any configuration capable of adjusting length X of the cable 210 along first side 262 or second side 264 of tray 11. For example, the leveling enhancement 260 may be in the form of a pin, a bar, or, as shown in FIG. 1, be in the form of a pair of pulleys 204.

Applicant has found that a twelve pulley system as shown in Figure 1 is particularly effective when practicing the invention. With this configuration, a first pulley 222 is positioned above first corner 214 of the tray 11 and a second pulley 224 is positioned below first corner 214. A third pulley 226 is positioned below second corner 216 and a fourth pulley 230 is positioned above second corner 216. A fifth pulley 232 is positioned below second corner 216.

A sixth pulley 234 and a seventh pulley 236 are preferably positioned along first side 262 of tray 11. The sixth pulley 234 and the seventh pulley 236 combine to form the leveling enhancement 260.

preferably, as shown in FIG. 1, one of the pulleys 204, for example, sixth pulley 234 is a fixed pulley and another pulley, for example, seventh pulley 236 is an adjustable pulley.

An eighth pulley 238 is positioned above third corner 218 and a ninth pulley 240 is positioned below third corner 218.

A tenth pulley 242 is positioned below fourth corner 220 and an eleventh pulley 244 is positioned above fourth corner 220. A twelfth pulley 246 is positioned below fourth corner 220.

The cable 210 may be driven by any suitable means. For example, as shown in FIG. 1, cable 210 may be driven by motor 270. Motor 270 may be connected to the cable in any suitable fashion, but preferably, the cable 210 is wrapped about capstan 272. The cable 210 may be wrapped one revolution or multiple revolutions about capstan depending on the torque required and the relative friction between the cable 210 and the capstan 272. The capstan 272 is connected to motor 270.

The capstan 210 may be any suitable durable capstan, for example, models No. 20E4490 and 20E4500 available from Seitz Company,.

The motor 270 may be any suitable motor capable of rotation in first direction 274 as well as second direction 276. Preferably, the motor 270 is a positioning motor, for example, a servo motor. Such a motor is readily commercially available. Such a motor is described more fully in U.S. Pat. No. 4,960,272 to Wierszewski et al., the relative portions thereof being incorporated herein by reference.

To provide sufficient vertical motion for the feeding tray 11, preferably, the first pulley 222, the fourth pulley 230, the eighth pulley 238, and the eleventh pulley 244 are positioned on first horizontal plane 280 positioned above the tray 11. Likewise, the second pulley 224, the third pulley 226, the fifth pulley 232, the ninth pulley 240, the tenth pulley 242 and the twelfth pulley 246 are positioned on second plane 282 below the feeding tray 11. The first plane 280 and the second plane 282 are separated by a vertical distance $Z_1$ which is greater than the vertical travel $Z_2$ of the feeding tray 11.

During operation when the motor 270 rotates in a first direction 274, the cable 210 moves in first direction 212. When the cable 210 moves in direction 212, the tray 11 moves downwardly. Conversely, when the motor 272 moves in second direction 276, the cable 210 moves in second direction 284. When the cable moves in second direction 284, the feeding tray 11 moves in an upward direction.

When assembling the media tray lifting mechanism 202 to the feeding tray 11, the cable 210 is strung from first pulley 222, to second pulley 224, to third pulley 226, to fourth pulley 230, to fifth pulley 232, to sixth pulley 234, to seventh pulley 236, to eighth pulley 238, to ninth pulley 240, to tenth is pulley 242, to eleventh pulley 244, to twelfth pulley 246, around capstan 272, and finally back to first pulley 222.

The fixed alignment or sixth pulley 234 serves as a factory installed alignment position to properly position the tray 11 when installing the lifting mechanism 202 to the copy machine. The adjustable pulley or seventh pulley 236 serves to provide adjustment for the first end 254 relative to the second end 256 of the feeding tray 11 allowing for adjustment of ΔH. Pulley 236 may be positioned above or below the cable 210, but as shown in FIG. 1, is positioned below the cable 210 so that a minor adjustment in the position of the pulley 236 may make a greater difference in the path length of the cable 210 or distance X.

Referring now to FIG. 1A, the leveling enhancement 260 is shown in greater detail. Fixed pulley 234 is fixedly secured to frame 206. Frame 206 may be made of any suitable, durable material, i.e. sheet metal. Fixed pulley 234 may be secured to frame 206 by any suitable method, for example, by welding or by fasteners (not shown). Adjustable pulley 236 is slidably secured to frame 206 by any suitable fashion. For example, the frame 206 may include an elongated slot 286 preferably in a position perpendicular to the cable 210. The adjustable pulley 236 may be secured to the frame 206 in any suitable fashion, for example, by a fastener such as a bolt or as shown in FIG. 1, be secured to the frame by means of an adjustable take up unit 290. Such a take up unit may be integral to the pulley. Such an integral pulley take up unit is available from bearing manufacturers. As stated earlier, the take up unit may be provided for an adjustment of ΔT such that the feeding tray 11 may have second end 256 adjusted in the vertical direction, an amount ΔH where ΔH may be as large as approximately 0.20 inches, 0.25 inches or 0.315 inches. Preferably, the idler pulley and the adjustment pulley are located within 6 inches of each other.

By providing a document tray with leveling enhancement, a feeding tray may be provided which may be adjustable during operation.

By providing a feeding tray with leveling enhancement in the tray cable lifting system, a tray may be provided which may be adjustable during installation of the copying module into the copying system.

By providing a feeding tray with leveling enhanced cable lift system a feeding tray may be adjustable to improve the alignment of sheets from the feeding tray to the paper path.

By providing a feeding tray with leveling enhancement, adjustments in the paper path from the feeding tray to the paper path may be accomplished during servicing of the machine as the cable and pulley wear and stretch.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A media tray lifting mechanism for use with a driving mechanism to present sheet media for processing in a printing machine, the mechanism comprising:

a tray for supporting the sheet media, said tray including a substantially rectangular shape, said tray defining four corners thereof;

a cable affixed in at least three spaced apart positions to said tray to form cable connections, said cable affixed to said tray in each of four positions, each of the four positions being adjacent each of the four corners of said tray;

a plurality of support pulleys affixed to the printing machine and movably attached to said cable for supporting said cable within the machine, at least two of said support pulleys associated with each of the cable connections to form pulley sets, at least one of the support pulleys within each pulley set subtending another pulley within the pulley set to provide a substantially vertical section of said cable therebetween;

a first adjustment pulley movably secured to the printing machine and movably attached to said cable, said adjustment pulley positioned between adjacent sets of pulley sets; and a second adjustment pulley adjacent said first mentioned adjustment pulley and positioned between said adjacent sets of pulley sets, said second adjustment pulley secured to the printing machine and operably associated with said cable.

2. A lifting mechanism according to claim 1, wherein said second adjustment pulley comprises an idler pulley adjacent said first adjustment pulley, said idler pulley rotatably secured to the printing machine and movably attached to said cable.

3. A lifting mechanism according to claim 2, wherein said idler pulley and said first adjustment pulley are located within 6 inches of each other.

4. A lifting mechanism according to claim 1, further comprising a capstan secured to said printing mechanism, said capstan operably connected to said cable and to the driving mechanism to transmit force therebetween.

5. A media tray lifting mechanism for use with a driving mechanism to present sheet media for processing in a printing machine, the mechanism comprising:

a tray for supporting the sheet media, said tray including a substantially rectangular shape, said tray defining four corners thereof;

a cable affixed in at least three spaced apart positions to said tray to form cable connections, said cable affixed to said tray in each of four positions, each of the four positions being adjacent each of the four corners of said tray;

a plurality of support pulleys affixed to the printing machine and movably attached to said cable for supporting said cable within the machine, at least two of said support pulleys associated with each of the cable connections to form pulley sets, at least one of the support pulleys within each pulley set subtending another pulley within the pulley set to provide a substantially vertical section of said cable therebetween; and an adjustment pulley movably secured to the printing machine and movably attached to said cable, said adjustment pulley positioned between adjacent sets of pulley sets, wherein said tray defines opposed sided and opposed ends, the opposed sides having a length substantially greater than the opposed ends, said adjustment pulley disposed between opposed ends so that the vertical position of the opposed ends may be adjusted relative to each other by adjusting the position of said adjustment pulley.

6. A lifting mechanism according to claim 5, wherein the position of the adjustment pulley has sufficient adjustment to permit the vertical position of the opposed ends may be adjusted relative to each other by at least 0.315 inches.

7. An electrophotographic printing machine for developing a latent image on sheet media, the printing machine having a media tray lifting mechanism for use with a driving mechanism to present the sheet media for processing in the printing machine, the lifting mechanism comprising:

a tray for supporting the sheet media, said tray including a substantially rectangular shape, said tray defining four corners thereof;

a cable affixed in at least three spaced apart positions to said tray to form cable connections, said cable affixed to said tray in each of four positions, each of the four positions being adjacent each of the four corners of said tray;

a plurality of support pulleys affixed to the printing machine and movably attached to said cable for supporting said cable within the machine, at least two of said support pulleys associated with each of the cable connections to form pulley sets, at least one of the support pulleys within each pulley set subtending another pulley within the pulley set to provide a substantially vertical section of said cable therebetween;

a first adjustment pulley movably secured to the printing machine and movably attached to said cable, said adjustment pulley positioned between adjacent sets of pulley sets; and a second adjustment pulley adjacent said first mentioned adjustment pulley and positioned between said adjacent sets of pulley sets, said second adjustment pulley secured to the printing machine and operably associated with said cable.

8. A printing machine according to claim 7, wherein said adjustment pulley comprises an idler pulley adjacent said first adjustment pulley, said idler pulley rotatable secured to the printing machine and movably attached to said cable.

9. A printing machine according to claim 8, wherein said idler pulley and said first adjustment pulley are located within 6 inches of each other.

10. A printing machine according to claim 7, further comprising a capstan secured to said printing mechanism, said capstan operably connected to said cable and to the driving mechanism to transmit force therebetween.

11. An electrophotographic printing machine for developing a latent image on sheet media, the printing machine having a media tray lifting mechanism for use with a driving mechanism to present the sheet media for processing in the printing machine, the lifting mechanism comprising:

a tray for supporting the sheet media, said tray including a substantially rectangular shape, said tray defining four corners thereof;

a cable affixed in at least three spaced apart positions to said tray to form cable connections, said cable affixed to said tray in each of four positions, each of the four positions being adjacent each of the four corners of said tray;

a plurality of support pulleys affixed to the printing machine and movably attached to said cable for supporting said cable within the machine, at least two of said support pulleys associated with each of the cable connections to form pulley sets, at least one of the support pulleys within each pulley set subtending another pulley within the pulley set to provide a substantially vertical section of said cable therebetween; and an adjustment pulley movably secured to the printing machine and movably attached to said cable, said adjustment pulley positioned between adjacent sets of pulley sets, wherein said tray defines opposed sided and opposed ends, the opposed sides having a length substantially greater than the opposed ends, said adjustment pulley disposed between opposed ends so that the vertical position of the opposed ends may be adjusted relative to each other by adjusting the position of said adjustment pulley.

12. A printing machine according to claim 11, wherein the position of the adjustment pulley has sufficient adjustment to permit the vertical position of the opposed ends may be adjusted relative to each other by at least 0.315 inches.

13. A method for adjusting the relative height of opposed ends of a rectangular tray for supplying a stack of sheet media in a supply bin of a printing machine, comprising the steps of:

supporting the rectangular tray on the corners thereof from a cable attached to a system of pulleys secured to the machine;

movably mounting an adjustable pulley to the printing machine between adjacent corners of the tray; and adjusting the position of the adjustable pulley relative to the printing machine so that the relative height of opposed ends of the rectangular tray is adjusted.

* * * * *